US010353311B2

(12) United States Patent
Ishikawa et al.

(10) Patent No.: US 10,353,311 B2
(45) Date of Patent: Jul. 16, 2019

(54) WHITE TONER FOR ELECTROSTATIC CHARGE IMAGE DEVELOPMENT AND IMAGE FORMING METHOD

(71) Applicant: Konica Minolta, Inc., Tokyo (JP)

(72) Inventors: Michiaki Ishikawa, Sagamihara (JP); Hiroyuki Kozuru, Otsuki (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/948,040

(22) Filed: Apr. 9, 2018

(65) Prior Publication Data

US 2018/0314175 A1 Nov. 1, 2018

(30) Foreign Application Priority Data

Apr. 26, 2017 (JP) ..... 2017-087114
Mar. 30, 2018 (JP) ..... 2018-066858

(51) Int. Cl.

| | |
|---|---|
| ***G03G 13/01*** | (2006.01) |
| ***G03G 9/097*** | (2006.01) |
| ***G03G 9/09*** | (2006.01) |
| ***G03G 9/10*** | (2006.01) |
| ***G03G 15/08*** | (2006.01) |
| ***G03G 15/00*** | (2006.01) |
| ***G03G 9/08*** | (2006.01) |

(52) U.S. Cl.

CPC ..... *G03G 9/0902* (2013.01); *G03G 9/0827* (2013.01); *G03G 9/09791* (2013.01); *G03G 9/10* (2013.01); *G03G 13/013* (2013.01); *G03G 15/0865* (2013.01); *G03G 15/6585* (2013.01)

(58) Field of Classification Search

None

See application file for complete search history.

(56) References Cited

U.S. PATENT DOCUMENTS

| | | | | |
|---|---|---|---|---|
| 7,398,036 | B2 * | 7/2008 | Katayanagi | G03G 9/0821 399/223 |
| 9,213,249 | B2 * | 12/2015 | Kadonome | G03G 9/0819 |
| 9,372,423 | B2 * | 6/2016 | Hori | G03G 9/0827 |
| 9,766,567 | B2 * | 9/2017 | Tasaki | G03G 9/09791 |
| 9,857,734 | B2 * | 1/2018 | Sakashita | G03G 15/161 |
| 2012/0208119 | A1 * | 8/2012 | Iwamoto | C09B 47/085 430/108.21 |

FOREIGN PATENT DOCUMENTS

| | | |
|---|---|---|
| JP | 5335330 B2 | 8/2013 |
| JP | 5335332 B2 | 8/2013 |

* cited by examiner

*Primary Examiner* — Janis L Dote

(74) *Attorney, Agent, or Firm* — Lucas & Mercanti, LLP

(57) ABSTRACT

A white toner for electrostatic charge image development contains a toner particle that includes a toner base particle containing a binder resin, a white colorant, and a releasing agent, and an external additive, wherein the toner particle contains, as the external additive, a fatty acid metal salt particle having a volume-based median diameter in a range of 0.5 to 1.5 μm, and an average circularity of the toner particles is in a range of 0.870 to 0.950.

3 Claims, 1 Drawing Sheet

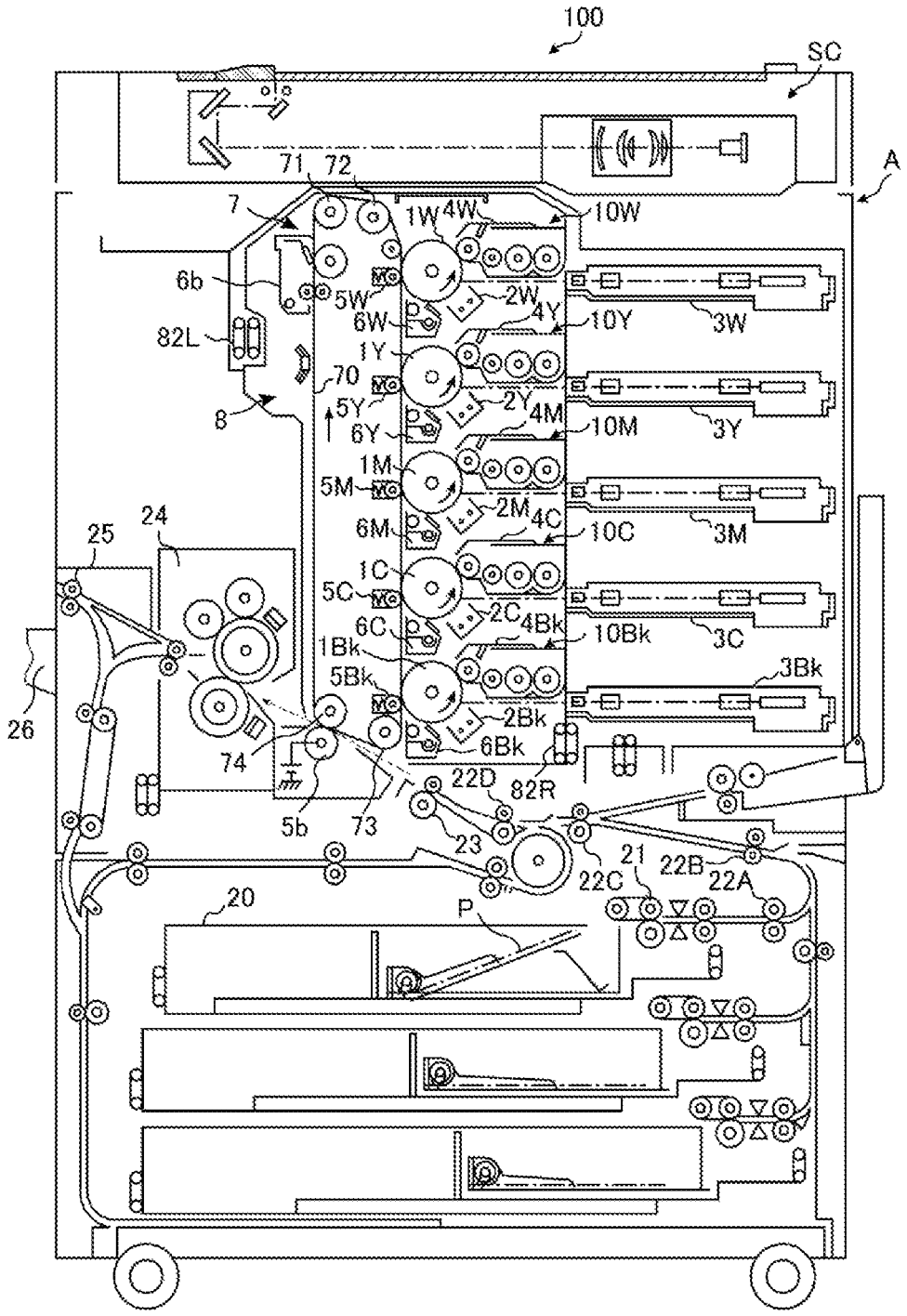
100
SC
A
71
72
7
1W
4W
10W
6b
5W
2W
6W
4Y
10Y
3W
82L
1Y
70
5Y
2Y
4M
10M
3Y
8
6Y
1M
5M
2M
4C
10C
3M
6M
25
24
1C
5C
2C
4Bk
10Bk
3C
6C
1Bk
3Bk
5Bk
2Bk
6Bk
26
74
22D
82R
5b
73
23
22C
21
22B
22A
20
P

WHITE TONER FOR ELECTROSTATIC CHARGE IMAGE DEVELOPMENT AND IMAGE FORMING METHOD

The entire disclosure of Japanese patent Application No. 2017-087114, filed on Apr. 26, 2017, is incorporated herein by reference in its entirety.

BACKGROUND

Technological Field

The present invention relates to a white toner for electrostatic charge image development and an image forming method, and more specifically relates to a white toner for electrostatic charge image development and an image forming method which can provide an extremely stable high-quality full color image for a long period even under a high stress condition.

Description of the Related Art

In recent years, a toner added with small-diameter lubricant (fatty acid metal salt particle) is known in order to achieve higher image quality and higher stability of an image output from a device using an electrophotographic system, such as a copying machine or a printer (refer to, JP 5335330 B2 and JP 5335332 B2, for example).

However, due to further miniaturization of such devices, a developing machine is especially further miniaturized, and image quality is needed to be satisfied with a developer amount less than that in the related art.

In a process using such a little amount of developer, a toner to be supplied is needed to be electrically charged in a short time, and therefore, it is necessary to mix the developer with carriers with higher stress than that in the related art.

Under such mixing stress, lubricant is separated from a toner particle surface even in a case of using the developer disclosed in JP 5335330 B2 and JP 5335332 B2. For example, in a case of a developing machine in which developer is supplied from a far side in a longitudinal direction of a developing sleeve, lubricant retained in a toner particle is supposed to be supplied uniformly to every corner of a photoreceptor surface, but the lubricant separated from the toner particle is quickly transferred onto the photoreceptor on the far side, and by the time the developer is moved to a near side of the developing sleeve, the lubricant is dried up, and this may cause various kinds of image problems inducing cleaning failure (streaky image defect).

On the other hand, there is demand for a white toner for electrostatic charge image development (hereinafter also simply referred to as white toner) as an image forming method on a wide variety of transfer materials.

With the white toner, whitening is performed for a binder resin by using titanium oxide particles, namely, inorganic fine particles since a long time ago, but a white toner containing a toner particle having small average circularity (average circularity of 0.950 or less) has a problem in which white colorant tends to be easily exposed on a toner particle surface and flowability of the toner is deteriorated.

Additionally, on the other hand, in a case of collectively fixing toners of four colors including yellow (Y), magenta (M, cyan (C) and black (Bk) together with a white toner, a toner layer becomes thicker, and therefore, it is inevitable to increase a fixing temperature, however; since simple increase of the fixing temperature only accelerates melting on an interface between the toner layer and a fixing roller, separability in fixing is deteriorated as a result.

SUMMARY

The present invention has been made in view of the above-described problems and situations, and an object thereof is to provide a white toner for electrostatic charge image development and an image forming method which can provide a highly stable high-quality full color image for a long period even under high stress condition.

To achieve the abovementioned object, according to an aspect of the present invention, a white toner for electrostatic charge image development reflecting one aspect of the present invention contains a toner particle that includes a toner base particle containing a binder resin, a white colorant, and a releasing agent, and an external additive, wherein the toner particle contains, as the external additive, a fatty acid metal salt particle having a volume-based median diameter in a range of 0.5 to 1.5 μm, and an average circularity of the toner particles is in a range of 0.870 to 0.950.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIGURE is a schematic diagram illustrating an exemplary image forming device according to an embodiment of the present invention.

DETAILED DESCRIPTION OF EMBODIMENTS

Hereinafter, one or more embodiments of the present invention will be described with reference to the drawings. However, the scope of the invention is not limited to the disclosed embodiments.

A white toner for electrostatic charge image development according to an embodiment of the present invention is characterized in containing, as an external additive, a fatty acid metal salt particle having a volume-based median diameter in a range of 0.5 to 1.5 μm, and also characterized in that average circularity of the toner particles is in a range of 0.870 to 0.950. These characteristics are common technical features in the inventions according to the respective claims.

As an embodiment of the present invention, it is preferable that the fatty acid metal salt is zinc stearate from the viewpoint of performance as lubricant and electrostatic toner retentivity.

Additionally, the white toner for electrostatic charge image development according to an embodiment of the present invention is preferably used in an image forming method in which the white toner is collectively transferred and then collectively fixed onto a transfer material by an intermediate transfer body together with a colored toner for electrostatic charge image development including colored colorant other than white.

The present invention can provide an image forming method including at least a charging step, a latent image forming step, a developing step, a transferring step, a fixing step, and a cleaning step, in which the transferring step includes: primarily transferring, to an intermediate transfer body, the white toner for electrostatic charge image development and the colored toner for electrostatic charge image development including colored colorant other than white; and secondarily transferring, onto a transfer material, a toner image formed on the intermediate transfer body.

Furthermore, it is preferable that average circularity of the toner base particles contained in the colored toner for electrostatic charge image development be in a range of 0.951 to 0.990 from the viewpoint of stability of an electrostatic property and low-temperature fixability.

Furthermore, from the viewpoint of long-term cleaning stability, it is preferable that the white toner for electrostatic charge image development be transferred to a non-image forming region of the intermediate transfer body corresponding to between transfer materials consecutively conveyed, and the white toner for electrostatic charge image development be recovered and also the intermediate transfer body be cleaned by using the white toner for electrostatic charge image development in the cleaning step.

In the following, the present invention, constituent elements thereof, and modes and aspects to carry out the present invention will be described in detail. Note that, in the present application, the term "to" representing a numerical range is used as a meaning to include, as a lower limit value and an upper limit value, numerical values specified before and after the "to".

«White Toner for Electrostatic Charge Image Development»

The white toner for electrostatic charge image development according to an embodiment of the present invention has the following characteristics: the white toner contains a toner particle including a toner base particle that includes a binder resin, white colorant, and a releasing agent; the toner particle contains, as the external additive, a fatty acid metal salt particle having a volume-based median diameter in the range of 0.5 to 1.5 μm; and the average circularity of the toner particles is in a range of 0.870 to 0.950.

Note that, in the present invention, the term "toner" represents an aggregate of toner particles.

Furthermore, the term "white" represents a color that satisfies the following conditions in a case of transferring only a white toner onto a transfer material: lightness L* measured on a surface thereof in accordance with JIS Z 8781-4:2013 in a CIEL*a*b* color system is 80 or more; and a* and b* are values of $-10 \leq a^* \leq 10$ and $-10 \leq b^* \leq 10$, respectively.

(Average Circularity of Toner Particles in White Toner for Electrostatic Charge Image Development)

Average circularity of toner particles in the white toner for electrostatic charge image development is in a range of 0.870 to 0.950. At a heterogeneous level in which the average circularity is less than 0.870, sufficient retentivity for lubricant cannot be achieved, and the lubricant is easily separated from a toner particle, and therefore, an image defect accompanied by ununiformity may be caused. In a case where the average circularity is larger than 0.950, the toner particle has a nearly spherical shape, and therefore, a cleaning effect at an intermediate transfer body or the like cannot be expected.

In the following, a measuring method for the average circularity of the toner particles (or toner base particles) will be described.

First, 10 mL of deionized water from which impurity solids and the like have been preliminarily removed are prepared in a container. A surfactant (alkylbenzene sulfonate) is added thereto as dispersant, and then 0.02 g of a measurement sample is further added and dispersed uniformly.

As a dispersing means, dispersing treatment is performed for two minutes by using an ultrasonic dispersing machine "TETORA150" (manufactured by Nikkaki Bios Co., Ltd.) to obtain dispersant for measurement. At this point, cooling is performed such that a temperature of the dispersant does not become 40° C. or more.

Additionally, in order to suppress variation in circularity, a device installation environment is controlled to be 23° C.±0.5° C. such that an inner temperature of a flow particle image analyzer "FPIA-2100" (manufactured by Sysmex Corporation) is kept within a range of 26 to 27° C., and automatic focus adjustment is performed by using 2 μm latex particles at predetermined intervals, preferably, every two hours.

The above flow particle image analyzer is used to measure circularity of a toner particle, and a concentration of the dispersant is readjusted such that a concentration of the toner particles at the time of measurement becomes 3000 to 10,000 pieces/μL, and measurement is performed for 1000 or more toner particles. After measurement, average circularity of the toner particles is acquired by using the measurement data while cutting data of a circle equivalent diameter less than 2 μm.

Circularity of the white toner can be controlled by controlling brittleness of a binder resin and selection of a kneading and pulverizing method, particularly, selection of a pulverizing method.

As the pulverizing method, use of a collision plate type jet mill (I-type mill), a high-speed rotor mill (such as Turbo Mill or Kryptron), and the like can be exemplified, and the collision plate type jet mill is directed to have lower circularity and the high-speed rotor mill is directed to have higher circularity. Additionally, particularly in the high speed rotary rotor mill, circularity is changed by controlling a temperature of a pulverizing unit, and the higher a temperature is, the higher the circularity is.

<Toner Base Particle>

The toner base particle according to an embodiment of the present invention includes a binder resin, white colorant, and a releasing agent.

(Binder Resin)

Examples of the binder resin according to an embodiment of the present invention include: homopolymers of styrene such as polystyrene, poly-p-styrene, and polyvinyl toluene, and a derivative substitution thereof; styrene-based copolymers such as a styrene-p-chlorostyrene copolymer, a styrene-propylene copolymer, a styrene-vinyltoluene copolymer, a styrene-methyl acrylate polymer, a styrene-ethyl acrylate copolymer, a styrene-butyl acrylate copolymer, a styrene-methyl methacrylate copolymer, a styrene-butyl methacrylate copolymer, a styrene-α-chloromethyl methacrylate copolymer, a styrene-acrylonitrile copolymer, a styrene-vinylmethyl ether copolymer, a styrene-vinyl methyl ketone copolymer, a styrene-butadiene copolymer, a styrene-isopropyl copolymer, a styrene-maleic acid ester copolymer, and styrene-maleic acid ester copolymers; polymethylmethacrylate; polybutylmethacrylate; polyvinyl chloride; polyvinyl acetate; polyethylene; polypropylene; polyester; polyurethane; a polyamide; an epoxy resin; polyvinyl butyral; a polyacrylic resin; losin; modified losin; a terpene resin; a phenol resin; an aliphatic hydrocarbon resin; an aromatic petroleum resin; chlorinated paraffin; paraffin wax; and the like, and these can be used alone or in combination.

(White Colorant)

As the white colorant according to an embodiment of the present invention, known white colorant can be suitably adopted, and for example, a titanium oxide, a zinc oxide, a barium sulfate, alumina, calcium carbonate, and the like can be exemplified.

Additionally, commercially available one can also be used, and as an example of the titanium oxide, ET-500W and ET-300W of Ishihara Sangyo Kaisha, Ltd. can be exemplified.

(Releasing Agent)

The toner base particle according to an embodiment of the present invention contains a releasing agent as an essential component.

As the releasing agent, a wax is preferably used. Examples of the wax include: hydrocarbon waxes such as a low molecular weight polyethylene wax, a low molecular weight polypropylene wax, a Fischer-Tropsch waxes, a microcrystalline wax, and a paraffin wax; ester waxes such as a carnauba wax, pentaerythritol behenate ester, behenyl behenate, and behenyl citrate; a fatty acid amide; and the like. These can be used alone or in combination of two or more kinds thereof.

Examples of a preferable commercially available product of the hydrocarbon wax include: "VISCOL 660P"; "VISCOL 550P" (manufactured by Sanyo Chemical Industries, Ltd.); "Polyethylene 6A" (manufactured by Allied Chemical Corporation); "HI WAX 400P", "HI WAX 100P", "HI WAX 200P", "HI WAX 320P", "HI WAX 220P", "HI WAX 2203A", and "HI WAX 4202E" (all manufactured by Mitsui Petrochemical Co., Ltd.); "HOECHST WAX PE520", "HOECHST WAX PE130", and "HOECHST WAX PE190" (all manufactured by Hoechst Japan Ltd.); and the like.

As the fatty acid amide, an alkylenebis fatty acid amide is preferable, and an alkylenebis fatty acid amide having a melting point in a range of approximately 100 to 180° C. is particularly preferable.

Examples of such preferable commercially available products of the alkylenebis fatty acid amide include: "BISAMIDE", "DAIYAMITSUDO 200", and "LEBLOND O" (all manufactured by Nippon Hydrogen Industry Co., Ltd.); "PLASTOFLOW" (manufactured by Nitto Kagaku Co., Ltd.); "ALFLOW H305" and "ALFLOW V-60" (manufactured by Nippon Oil & Fats Co., Ltd.); "HOECHST WAX C" (manufactured by Hoechst Japan Ltd.); "NOBUKO WAX-22DS" (manufactured by Nobuko Chemical); "ADVAWAX-28Q" (manufactured by Advance); "KAO WAX EB" (manufactured by Kao Corporation); "BARISHIN 285" (manufactured by Baker Caster Oil Company); and the like. Particularly, the "HOECHST WAX C" is preferable.

Additionally, as the ester waxes, fatty acid ester having a melting point of approximately 30 to 130° C. or a partially saponified product thereof are preferable, and for example, fatty acid polyhydric alcohol ester, fatty acid higher alcohol ester, ester based on ester obtained by partially mixing a fatty acid with polyhydric alcohol, and the like can be exemplified. Particularly, the fatty acid higher alcohol ester is preferable.

As the wax, the one having a melting point of 50 to 150° C. is preferable from the viewpoint to ensure low-temperature fixability and a releasing performance of the toner. A content ratio of the wax is preferably in a range of 2 to 20 mass % with respect to a total amount of the binder resin, more preferably, in a range of 3 to 18 mass %, and still more preferably in a range of 4 to 15 mass %.

Additionally, it is preferable that a domain be formed as an existing state of the wax inside a toner particle in order to exert an effect of the releasing performance. The respective functions are easily exerted by forming such a domain inside a binder resin.

Preferably, the wax has a domain diameter in a range of 300 nm to 2 μm. Within this range, the sufficient effect can be obtained in releasing performance, and ability to retain small-diameter lubricant can also be ensured.

<External Additive>

Known particles such as an inorganic fine particle and an organic fine particle and lubricant can be added onto a surface of a toner base particle as external additives from the viewpoint of improving an electrostatic property and flowability as a toner or cleaning performance. As these external additives, various kinds may be used in combination.

The lubricant is used to further improve cleaning performance and transferability, and examples of the lubricant include (higher) fatty acid metal salt particles such as: salt of zinc, aluminum, copper, magnesium, calcium, or the like of stearic acid; salt of zinc, manganese, iron, copper, magnesium, or the like of oleic acid; salt of zinc, copper, magnesium, calcium, or the like of palmitic acid; and salt of zinc, calcium, or the like of linoleic acid.

An embodiment of the present invention is characterized in containing, as the external additive, a fatty acid metal salt particle (lubricant) having a volume-based median diameter in a range of 0.5 to 1.5 μm. The reason is that the effects of the present invention can be effectively exerted by using the lubricant having the above-mentioned particle size range on the basis of physical, electrostatic, and retentivity relations with the above-described toner base particle. In a case where the volume-based median diameter of the fatty acid metal salt particle is less than 0.5 μm, deformation and fusion may be caused by mixing stress of a developing machine and surfaces of a carrier and other members may be contaminated. On the other hand, in a case where the volume-based median diameter of the fatty acid metal salt particle is larger than 1.5 μm, retentivity with the toner base particle is deteriorated and separation is easily caused, and an image defect accompanied by ununiformity may be caused.

The volume-based median diameter (volume average particle size) of the fatty acid metal salt particle (lubricant) can be measured by using a laser diffraction particle size measuring device SALD-2100 (manufactured by Shimadzu Corporation).

As the fatty acid metal salt (particle) having the above-described volume-based median diameter, the above-mentioned various kinds of (higher) fatty acid metal salts (particles) can be used, and particularly, metal salt of stearic acid is preferable, and for example, calcium stearate, magnesium stearate, zinc stearate, and the like can be exemplified, but particularly, zinc stearate is preferable from the viewpoint of performance as the lubricant and electrostatic toner retentivity.

Preferably, the content of the fatty acid metal salt particle (lubricant) having the volume-based median diameter is in a range of 0.05 to 0.60 mass % with respect to a total amount of the toner. When the content of the fatty acid metal salt particle (lubricant) is 0.05 mass % or more, the effects of the present invention can be effectively exerted. When the content of the fatty acid metal salt particle (lubricant) is 0.60 mass % or less, inhibition of charging between the toner and a carrier caused by excessive addition is suppressed, and furthermore, the effects of the present invention can be effectively exerted.

In the present invention, at least the lubricant having the above-mentioned particle size range (fatty acid metal salt particle having the above-mentioned volume-based median diameter) is to be used as the external additive, and besides, a known inorganic fine particle, a known organic fine particles, and the like may also be used in combination.

Examples of the inorganic fine particle include: inorganic oxide fine particles such as silica, titania and alumina; inorganic stearic acid compound fine particles such as an aluminum stearate fine particle and a zinc stearate fine particle; and inorganic titanic acid compound fine particles such as calcium titanate, strontium titanate, and zinc titanate. Among them, the inorganic titanate compound fine particles (metal oxide fine particles) such as strontium titanate and calcium titanate have a characteristic of a high polishing effect. Additionally, as the silica particle, silica manufactured by a wet method, such as colloidal silica, hydrolyzate of alkoxysilane (silica prepared by a sol-gel method), or silica manufactured by a dry method, such as fumed silica and molten silica, are used.

These inorganic fine particles are subjected to gloss treatment, hydrophobic treatment, and the like as needed by using a silane coupling agent, a titanium coupling agent, higher fatty acid, silicone oil, or the like in order to improve heat-resistant storage property and environmental stability. From the viewpoint of improving flowability of the external additive, it is preferable to use silica particles subjected to the hydrophobic treatment (surface treatment) by using hexamethyldisilazane (HMDS) or the like.

As the inorganic fine particles, it is preferable to use an inorganic fine particle having a number average primary particle size of approximately 5 nm to 2 μm and applied with or without spherical hydrophobic treatment. Meanwhile, the number average primary particle size of the inorganic fine particle can be calculated by using an electron microscope photograph, more specifically, by photographing a 30,000-fold photograph of a toner sample with a scanning electron microscope, and then fetching this photographed image with a scanner. An external additive existing on a toner surface of the photographed image is binarized by an image processing analyzer LUZEX (registered trademark) AP (manufactured by NIRECO CORPORATION), and a horizontal Feret diameter is calculated for one hundred pieces in each kind of an external additive, and an average value thereof is defined as the number average primary particle size.

Two kinds of particles having different number average primary particle sizes (such as silica particles) may also be used as the inorganic fine particles. For example, the number average primary particle diameter having a larger particle size preferably is in a range of 60 to 250 nm, more preferably, in a range of 80 to 200 nm. With this range, adhesion of a particle having a larger particle size to a toner base particle is accelerated, and stability of an electric charge amount and cleaning performance can be improved. Additionally, the number average primary particle diameter having a smaller particle size preferably is in a range of 5 to 45 nm, more preferably, in a range of 12 to 40 nm. With this range, a good electrostatic property of a small diameter silica particle can be sufficiently obtained, and furthermore easy and uniform adhesion to the surface of the toner base particle can be achieved. As a result, an initial electric charge amount and stability of the electric charge amount can be improved in a high temperature and high humidity environment.

As the organic fine particle, a spherical organic fine particle having a number average primary particle size of approximately 10 nm to 2 μm can be used. More specifically, an organic fine particle including a homopolymer of styrene, methyl methacrylate, or the like, or a copolymer thereof can be used. Meanwhile, a number average primary particle size of an organic fine particle can be calculated by using an electron microscope photograph in a manner similar to the number average primary particle size of the inorganic fine particle.

An adding amount of the external additive is preferably in a range of 0.1 to 10.0 parts by mass with respect to 100 parts by mass of toner base particles.

As a method of adding the external additive, an adding method using various kinds of known mixing devices such as a turbulent mixer, a HENSCHEL MIXER, a NAUTA MIXER, a V-shape mixer, and the like can be exemplified.

<Charge Control Agent>

The toner particle according to an embodiment of the present invention may contain various kinds of additives such as an electric charge control agent as needed. The electric charge control agent is not particularly limited, and various kinds of known compounds can be used.

<Particle Size of Toner Particle>

A toner particle constituting a white toner preferably has a particle size in a range of 4 to 12 μm, more preferably, in a range of 5 to 9 μm, in a volume-based median diameter.

Since the volume-based median diameter is in the above-described range, transfer efficiency is improved, halftone image quality is improved, and image quality of a thin line, a dot, and the like is improved.

A volume-based median diameter of a toner particles is measured and calculated by using a measuring device obtained by connecting a data processing computer system (manufactured by Beckman Coulter, Inc.) to a "MULTISIZER 3" (manufactured by Beckman Coulter, Inc.).

More specifically, 0.02 g of the toner is added and blended with 20 mL of surfactant solution (for example, surfactant solution obtained by diluting, 10 times, neutral detergent including a surfactant component with pure waters in order to disperse toner particles), and then ultrasonic dispersing treatment is applied for one minute to prepare dispersant of the toner particles, and this dispersant of the toner particles is injected with a pipette into a beaker containing "ISOTON II" (manufactured by Beckman Coulter, Inc.) located inside a sample stand until concentration indication of the measuring device reaches 5 to 10 mass %. Here, with this concentration range, a reproducible measurement value can be obtained. Then, in the measuring device, measurement particle count number is set to 25000 pieces, an aperture diameter is set to 50 μm, a frequency value is calculated by dividing a measurement value range 1 to 30 μm into 256 sections, and a particle size corresponding to 50% of a largest volume-based cumulative fraction is determined as a volume-based median diameter.

<Developer for Electrostatic Charge Image Development>

The white toner for electrostatic charge image development according to an embodiment of the present invention can be used as a non-magnetic single component developer, but may also be mixed with a carrier and used as a two-component developer. In the case of using the white toner as the two-component developer, it is possible to use, as a carrier, magnetic particles including known materials in the related art, such as metals like iron, ferrite, and magnetite, and an alloy of these metals with a metal like aluminum or lead, and particularly, a ferrite particle is preferable. Additionally, as the carrier, a coated carrier in which a surface of a magnetic particle is coated with a coating agent such as a resin, or a dispersed carrier obtained by dispersing magnetic fine powder inside a binder resin may also be used.

A volume-based median diameter of the carrier is preferably in a range of 15 to 100 μm, more preferably, in a range of 25 to 60 μm. The volume-based median diameter of the carrier can be typically measured by a laser diffraction particle size distribution measuring device "HELOS" including a wet type dispersing machine (manufactured by SYMPATEC, GmbH).

<Manufacturing Method of White Toner for Electrostatic Charge Image Development>

A manufacturing method of the white toner for electrostatic charge image development according to an embodiment of the present invention is not particularly limited, and a pulverizing method, an emulsion polymerization aggregation method, or an emulsion aggregation method can be exemplified, but it is preferable that the white toner be manufactured by the pulverizing method from the viewpoint that average circularity of toner particles is set in the range of 0.870 to 0.950.

As the manufacturing method of the white toner, an exemplary case of using the pulverizing method will be described below.

(1) Step of mixing a binder resin, white colorant, and a releasing agent, and further an internal additive as needed, by a HENSCHEL MIXER or the like (2) Step of kneading while heating the obtained mixture with an extrusion kneader or the like (3) Step of coarsely pulverizing the obtained kneaded material with a hammer mill or the like and then further pulverizing the same with a turbo mill pulverizer or the like (4) Step of performing fine powder classifying processing by using an air-flow classifier utilizing, for example, a Coanda effect to form a toner base particle (5) Step of adding an external additive to the toner base particle The emulsion polymerization aggregation method is a manufacturing method for a toner particle, in which dispersant of fine particles of a binder resin manufactured by an emulsion polymerization method (hereinafter also referred to as "binder resin fine particles") is mixed with dispersant of fine particles of colorant (hereinafter also referred to as "colorant fine particles") and also with dispersant of a releasing agent such as a wax, and the mixture is aggregated until a toner particle comes to have a desired particle size, and furthermore a shape is controlled by performing fusion between binder resin particles.

Additionally, the emulsion aggregation method is a manufacturing method for a toner particle, in which resin particle dispersant is obtained by charging droplets of binder resin solution dissolved in a solvent into a poor solvent, and the resin particle dispersant is mixed with colorant dispersant and releasing agent dispersant such a wax, and then the mixture is agglomerated until a desired particle size is achieved, and additionally, a shape is controlled by performing fusion between binder resin particles.

As the manufacturing method for a white toner, an exemplary case of using the emulsion polymerization aggregation method will be described below.

(1) Step of preparing dispersant obtained by dispersing fine particles of white colorant in an aqueous medium, and dispersant obtained by dispersing releasing agents (2) Step of preparing dispersant obtained by dispersing, in an aqueous medium, binder resin fine particles containing internal additives as needed (3) Step of preparing dispersant of binder resin fine particles by emulsion polymerization (4) Step of mixing the dispersant of fine particles of white colorant with the dispersant of binder resin fine particles, and aggregating, associating, and fusing the fine particles of the white colorant and the binder resin fine particles to form a toner base particle (5) Step of filtering a toner base particle from the dispersion system (aqueous medium) of toner base particles, and removing surfactant and the like (6) Step of drying the toner base particle (7) Step of adding an external additive to the toner base particle In the case of manufacturing a white toner by the emulsion polymerization aggregation method, a binder resin fine particle obtained by the emulsion polymerization method may have a multilayer structure of two or more layers formed of binder resins having different compositions, and the binder resin fine particle having such a structure, for example, a two-layer structure can be obtained by: preparing dispersant of resin particles by emulsion polymerization treatment in accordance with a usual method (first stage polymerization); adding a polymerization initiator and a polymerizable monomer to the obtained dispersant; and applying this system with polymerization treatment (second stage polymerization).

Additionally, a toner particle having a core-shell structure can also be obtained by the emulsion polymerization aggregation method, and more specifically, the toner particle having a core-shell structure can be obtained by: first aggregating, associating, and fusing binder resin fine particles for a core particle with fine particles of white colorant to prepare the core particle; and then adding binder resin fine particles for a shell layer to dispersant of core particles to form the shell layer that coats a surface of the core particle by aggregating and fusing the binder resin fine particles for the shell layer onto the surface of the core particle.

«Image Forming Method»

An image forming method according to an embodiment of the present invention includes at least a charging step, a latent image forming step, a developing step, a transferring step, a fixing step and a cleaning step, and it is preferable to use a white toner for electrostatic charge image development of the present invention and a colored toner for electrostatic charge image development including colored colorant other than white (hereinafter also simply referred to as a colored toner). With this image forming method, an image having a concealment property, hues, and transferability which may satisfy demands of the production print market can be formed.

<Colored Toner for Electrostatic Charge Image Development Containing Colored Colorant Other than White>

A colored toner for electrostatic charge image development containing colored colorant other than white (for example, yellow (Y), magenta (M), cyan (C), or black (Bk)) is not particularly limited, and a known toner such as a toner containing general colored colorant can be used.

Average circularity of toner base particles in the colored toner for electrostatic charge image development is preferably in a range of 0.951 to 0.990. The average circularity of the toner base particles in the colored toner can be obtained in a manner similar to the average circularity of the toner particles in the white toner for electrostatic charge image development.

A manufacturing method for the colored toner is not particularly limited, but the colored toner is preferably manufactured by the emulsion polymerization method in order to achieve the above-mentioned average circularity.

(Charging Step)

In this step, an electrophotographic photoreceptor is charged. A charging method is not particularly limited, and for example, a charging means described later can be suitably used.

(Latent Image Forming Step)

In this step, an electrostatic latent image is formed on an electrophotographic photoreceptor (electrostatic latent image carrier).

The electrophotographic photoreceptor is not particularly limited but, for example, a drum-shaped member formed of an organic photoreceptor such as polysilane or phthalopolymethine can be exemplified.

An electrostatic latent image is formed by uniformly charging a surface of the electrophotographic photoreceptor with the charging means, and exposing the surface of the electrophotographic photoreceptor in an image form by using an exposing means.

The exposing means is not particularly limited, and the one described later can be used.

(Developing Step)

The developing step is a step to form a toner image by developing the electrostatic latent image with a thy developer including a toner.

The toner image is formed by using the dry developer including the toner, for example, by using a developing means described later.

More specifically, the toner and the carrier are mixed and stirred in the developing means, for example, and the toner is charged by friction generated at that time and retained on a surface of a rotating magnet roller, and a magnetic brush is formed. Since the magnet roller is located near the electrophotographic photoreceptor, a part of the toner constituting the magnetic brush formed on the surface of the magnet roller is moved to the surface of the electrophotographic photoreceptor by electric attraction force. As a result, the electrostatic latent image is developed with the toner, and a toner image is formed on the surface of the electrophotographic photoreceptor.

(Transferring Step)

In this step, a toner image is transferred to a transfer material.

The toner image is transferred to the transfer material by the toner image being peeled and charged onto the transfer material.

As the transferring means, for example, a corona transfer device by corona discharge, a transfer belt, a transfer roller, or the like can be used.

Additionally, for example, an intermediate transfer body is used in the transferring step, and the transferring step can be performed not only by a mode in which a toner image is primarily transferred onto the intermediate transfer body and then the toner image is secondarily transferred onto a transfer material but also by another mode in which a toner image formed on an electrophotographic photoreceptor is directly transferred onto a transfer material, for example.

The transfer material is not particularly limited, and various kinds of materials such as plain papers from a thin paper to a thick paper, a high-quality paper, a coated print paper such as an art paper or a coated paper, a commercially available Japanese paper, a postcard paper, a plastic film for an OHP, a cloth, and the like can be exemplified.

(Fixing Step)

In the fixing step, a toner image transferred to the transfer material is fixed onto a transfer material. The fixing method is not particularly limited, and a known fixing means as described later can be used. More specifically, it is possible to exemplify a heat roller fixing system including: a heating roller provided with a heating source inside thereof; and a pressurizing roller having a fixing nip portion in a manner pressed against the heating roller.

(Cleaning Step)

In this step, dry developer not used or not transferred and remaining on developer carriers such as a developing roller, a photoreceptor, and an intermediate transfer body is removed from the developer carriers.

A cleaning method is not particularly limited, but it is preferable to adopt a method of using a blade that has a tip contacting the photoreceptor and abrades a surface of the photoreceptor, and for example, a cleaning means as described later can be used.

Additionally, in the cleaning step, it is preferable that a white toner for electrostatic charge image development be transferred to a non-image forming region of the intermediate transfer body corresponding to between transfer materials consecutively conveyed, and the white toner for electrostatic charge image development be recovered by the cleaning means such as the blade and also the intermediate transfer body be cleaned by using the white toner for electrostatic charge image development.

«Image Forming Device»

FIGURE illustrates, as an example, an image forming device 100 in which the white toner for electrostatic charge image development of the present invention can be used.

The image forming device has a charging means, an electrostatic charge image forming means, a developing means, a transferring means, a fixing means, and a cleaning means, and the developing means preferably has a mode of forming a toner image by developing an electrostatic image with developer for electrostatic charge image development containing the white toner for electrostatic charge image development of the present invention.

Additionally, it is preferable that the image forming device have five or more electrostatic charge image forming means and five or more developing means respectively, for example, five electrostatic charge image forming means and five developing means for respective five colors such as white (W), yellow (Y), magenta (M), cyan (C), and black (Bk) because it is possible to form a full color image achieving white color having a concealment property, hues, and transferability which may satisfy demands of the production print market.

The image forming device 100 is referred to as a tandem type color image forming device, and includes five sets of image forming units 10W, 10Y, 10M, 10C, 10Bk, an endless belt-like intermediate transfer body unit 7, a paper feeding means 21, and a fixing means 24. An original image reading device SC is disposed at a top portion of a main body A of the image forming device 100.

The image forming unit 10W that forms a white image has a drum-shaped photoreceptor 1W, a charging means 2W, an exposing means 3W, a developing means 4W, a primary transfer roller 5W as a primary transferring means, and a cleaning means 6W.

The image forming unit 10Y that forms a yellow color image has a charging means 2Y, an exposing means 3Y, a developing means 4Y, a primary transfer roller 5Y as a primary transferring means, and a cleaning means 6Y which are disposed in the periphery of a drum-shaped photoreceptor 1Y.

The image forming unit 10M that forms a magenta image has a drum-shaped photoreceptor 1M, a charging means 2M, an exposing means 3M, developing means 4M, a primary transfer roller 5M as a primary transferring means, and a cleaning means 6M.

The image forming unit 10C that forms a cyan image has a drum-shaped photoreceptor 1C, a charging means 2C, an exposing means 3C, a developing means 4C, a primary transfer roller 5C as a primary transferring means, and a cleaning means 6C.

The image forming unit 10Bk that forms a black image has a drum-shaped photoreceptor 1Bk, a charging means 2Bk, an exposing means 3Bk, a developing means 4Bk, a primary transfer roller 5Bk as a primary transferring means, and a cleaning means 6Bk.

The five sets of image forming units (10W, 10Y, 10M, 10C, and 10Bk) respectively include, centering the photoreceptors 1W, 1Y, 1M, 1C and 1Bk, the charging means 2W, 2Y, 2M, 2C, and 2Bk, the exposing means 3W, 3Y, 3M, 3C, and 3Bk serving as electrostatic charge image forming means, the rotational developing means 4W, 4Y, 4M, 4C, and 4Bk, and the cleaning means 6W, 6Y, 6M, 6C, and 6Bk to clean the photoreceptors 1W, 1Y, 1M, 1C, and 1Bk.

Since the image forming units 10W, 10Y, 10M, 10C, and 10Bk have the same structures except that colors of toner images formed on the respective photoreceptors 1W, 1Y, 1M, 1C, and 1Bk are different, a detailed description will be provided below by exemplifying the image forming unit 10W.

In the image forming unit 10W, the charging means 2W, exposing means 3W, developing means 4W, and cleaning means 6W are disposed in the periphery of the photoreceptor 1W serving as an image forming body, and a white (W) toner image is formed on the photoreceptor 1W. Additionally, in the present embodiment, at least the photoreceptor 1W, charging means 2W, developing means 4W, and cleaning means 6W of the image forming unit 10W are provided in an integrated manner.

The charging means 2W is a means to apply uniform potential to the photoreceptor 1W. In the present invention, a contact or non-contact type roller charging system or the like can be exemplified as the charging means.

The exposing means 3W is an electrostatic charge image forming means to perform exposure on the basis of an image signal (white) and form an electrostatic latent image corresponding to a white image on the photoreceptor 1W to which the uniform potential is applied by the charging means 2W, and as the exposing means 3W, a member formed of an LED on which light emitting elements are arrayed in an axial direction of the photoreceptor 1W and an image forming element, a laser optical system, or the like is used.

The developing means 4W includes, for example: a developing sleeve that incorporates a magnet and is rotated while retaining developer; and a voltage application device that apples direct current and/or alternating current bias voltage between the developing sleeve and the photoreceptor. Meanwhile, particularly, it is preferable that the developing means 4W form a toner image by developing an electrostatic charge image by using the developer for electrostatic charge image development containing the white toner for electrostatic charge image development of the present invention.

As an example of the fixing means 24, it is possible to exemplify a heat roller fixing system including a heating roller provided with a heating source inside thereof and a pressurizing roller having a fixing nip portion in a manner pressed against the heating roller.

The cleaning means 6W includes a cleaning blade and a brush roller provided on a more upstream side of the cleaning blade.

As the image forming device 100, constituent elements such as the photoreceptor, developing means, and cleaning means are integrally coupled as a process cartridge (image forming unit), and this image forming unit may be detachably attached to a device main body. Additionally, the process cartridge (image forming unit) may be formed by integrally supporting at least one of the charging means, exposing means, developing means, transferring means, and cleaning means together with the photoreceptor so as to form a single image forming unit detachable to the device main body, and may form a detachable structure by using a guiding means such as a rail of the device main body.

The endless belt-like intermediate transfer body unit 7 has an endless belt-like intermediate transfer body 70 as a second image carrier having a semi-conductive endless belt rotatably supported by being wound around a plurality of rollers.

Images of the respective colors formed by the image forming units 10W, 10Y, 10M, 10C, and 10Bk are sequentially transferred onto the endless belt-like intermediate transfer body 70 by the primary transfer rollers 5W, 5Y, 5M, 5C, and 5Bk serving as the primary transferring means, and a combined color image is formed. A transfer material (an image carrier that carries a fixed final image: for example, a plain paper, a transparent sheet, or the like) P stored in a paper feed cassette 20 is fed by a paper feeding means 21, conveyed to a secondary transfer roller 5*b* serving as a secondary transferring mean via a plurality of intermediate rollers 22A, 22B, 22C, and 22D and a resist roller 23, and color images are collectively transferred onto the transfer material P through secondary transfer. The transfer material P to which the color images have been transferred is applied with the fixing processing by the fixing means 24, caught by a paper discharging roller 25, and placed on a paper discharge tray 26 outside the machine. Here, transfer carriers for a toner image formed on a photoreceptor, such as an intermediate transfer body or a transfer material, are collectively referred to as transfer media.

On the other hand, after a color image is transferred onto the transfer material P by the secondary transfer roller 5*b* serving as the secondary transferring means, a residual toner is removed by the cleaning means 6*b* from the endless belt-like intermediate transfer body 70 where the transfer material P has been self-stripped.

During image forming processing, the primary transfer roller 5Bk constantly contacts the photoreceptor 1Bk. Other primary transfer rollers 5W, 5Y, 5M, and 5C contact the respective corresponding photoreceptors 1W, 1Y, 1M, and 1C only during color image forming.

Additionally, the primary transfer roller 5W may be made to contact the photoreceptor 1W also in a time other than during image forming, and the white toner for electrostatic charge image development of the present invention may be developed and transferred onto the intermediate transfer body 70.

Since no image is normally formed between transfer materials P consecutively conveyed, toner images of the respective colors are not transferred to a non-image forming area of the intermediate transfer body 70 corresponding to between the transfer materials P, but the white toner for electrostatic charge image development of the present invention is developed and transferred onto the non-image forming region of the intermediate transfer body 70. Of course, this white toner is not transferred to the transfer material P, and therefore, the white toner is retained at the intermediate transfer body 70 without being transferred by the secondary transfer roller 5*b*, and removed by the cleaning means 6*b* afterward. Here, since the average circularity of toner particles of the white toner is in the range of 0.870 to 0.950, fine toner spent components on the intermediate transfer body 70 can be scraped off by an edge portion of a toner particle recovered by the cleaning means 6*b*, and not only the cleaning means 6*b* but also the white toner can be made to function as the cleaning means.

The secondary transfer roller 5*b* contacts the endless belt-like intermediate transfer body 70 only when the transfer material P passes here to perform secondary transfer.

Furthermore, a housing 8 can be drawn out from the device main body A via support rails 82L and 82R.

The housing 8 includes the image forming units 10W, 10Y, 10M, 10C, and 10Bk and the endless belt-like intermediate transfer body unit 7.

The image forming units 10W, 10Y, 10M, 10C, and 10Bk vertically arranged in tandem placement. The endless belt-like intermediate transfer body unit 7 is disposed on the left side of the photoreceptors 1W, 1Y, 1M, 1C and 1Bk in the drawing. The endless belt-like intermediate transfer body unit 7 includes: the endless belt-like intermediate transfer body 70 that can be rotated by being wounded around the rollers 71, 72, 73, 74; the primary transfer rollers 5W, 5Y, 5M, 5C, 5Bk; and the cleaning means 6*b*.

Meanwhile, in the image forming device 100 of FIGURE, a color laser printer is illustrated but application to a monochrome laser printer or a copy machine is also possible. Additionally, as an exposure light source, a light source other than a laser, such as an LED light source, may also be used.

Furthermore, the image forming device 100 preferably has five or more electrostatic charge image forming means and five or more developing means respectively as described above because it is possible to form a full color image achieving white color having a concealment property, hues, and transferability which may satisfy demands of the production print market.

EXAMPLES

In the following, the present invention will be more specifically described using Examples, but the present invention is not limited thereto.

«Preparation of Fatty Acid Metal Salt»

Fatty acid metal salts S1 to S8 were prepared in the following manner.

<Preparation of Fatty Acid Metal Salt S1>

140 parts by weight of stearic acid were charged to 1000 parts by weight of ethanol, and mixed at 75° C., and then 50 parts by weight of zinc hydroxide were slowly added and mixed for one hour. After that, the mixture was cooled until a temperature becomes 20° C., and an obtained product was taken out and dried at 150° C. to remove ethanol. An obtained solid of zinc stearate was coarsely pulverized with a hammer mill, and subsequently finely pulverized with a jet stream mill "I-20 JET MILL" (manufactured by Nippon Pneumatic Mfg. Co., Ltd.), and classified by a wind-driven classifier "DS-20/DS-10 CLASSIFIER" (manufactured by Nippon Pneumatic Mfg. Co., Ltd.) with a cut point of 1.1 μm, thereby preparing the fatty acid metal salt S1 including zinc stearate having a volume average particle size of 0.72 μm.

Note that, in the present Example, a volume-based median diameter (volume average particle size) of a fatty acid metal salt particle was measured by using a laser diffraction particle size measuring device SALD-2100 (manufactured by Shimadzu Corporation).

<Preparation of Fatty Acid Metal Salt S2>

The fatty acid metal salt S2 including zinc stearate having a volume average particle size of 0.51 μm was prepared in a manner similar to preparation of the fatty acid metal salt S1 except that the cut point was changed to 0.8 μm.

<Preparation of Fatty Acid Metal Salt S3>

The fatty acid metal salt S3 including zinc stearate having a volume average particle size of 1.48 μm was prepared in a manner similar to preparation of the fatty acid metal salt S1 except that the cut point was changed to 1.9 μm.

<Preparation of Fatty Acid Metal Salt S4>

The fatty acid metal salt S4 including calcium stearate having a volume average particle size of 0.78 μm was prepared in a manner similar to preparation of the fatty acid metal salt S1 except that zinc hydroxide was changed to calcium hydroxide.

<Preparation of Fatty Acid Metal Salt S5>

The fatty acid metal salt S5 including calcium stearate having a volume average particle size of 0.52 μm was prepared in a manner similar to preparation of the fatty acid metal salt S2 except that zinc hydroxide was changed to calcium hydroxide.

<Preparation of Fatty Acid Metal Salt S6>

The fatty acid metal salt S6 including calcium stearate having a volume average particle size of 1.49 μm was prepared in a manner similar to preparation of the fatty acid metal salt S3 except that zinc hydroxide was changed to calcium hydroxide.

<Preparation of Fatty Acid Metal Salt S7>

The fatty acid metal salt S7 including zinc stearate having a volume average particle size of 0.42 μm was prepared in a manner similar to preparation of the fatty acid metal salt S1 except that the cut point was changed to 0.5 μm.

<Preparation of Fatty Acid Metal Salt S8>

The fatty acid metal salt S8 including zinc stearate having a volume average particle size of 1.67 μm was prepared in a manner similar to preparation of the fatty acid metal salt S1 except that the cut point was changed to 2.0 μm.

«Manufacture of Toner»

Toners TW1 to TW5 and T1 to T8 were manufactured in the following manner.

<Manufacture of Toner TW1>

(1) Manufacture of Toner Base Particle TW1

Binder resin: 100 parts by mass of styrene n-butyl acrylate copolymer (Mw: 111000, Mn: 4000, Mw/Mn: 26)

White colorant: 50 parts by mass of titanium oxide ET-500W (manufactured by Ishihara Sangyo Kaisha, Ltd.)

Releasing agent: 5 parts by mass of polyolefin (VISCOL 660P, manufactured by Sanyo Chemical Industries, Ltd.)

Releasing agent: 5 parts by mass of alkylenebis fatty acid amide (HOECHST WAX C1, manufactured by Hoechst AG)

These materials were mixed, melted, kneaded, and cooled, and then coarsely pulverized and then finely pulverized by using a turbo mill (cooling water temperature: 5° C.), and subsequently classified to prepare white toner base particles TW1 having a volume average particle size of 7.1 μm and an average circularity of 0.878.

Meanwhile in the present Example, the volume average particle size of the toner base particle was measured as follows.

The volume average particle size of the toner base particles was measured and calculated by using a measuring device formed by connecting a data processing computer system (manufactured by Beckman Coulter, Inc.) to "MULTISIZER 3" (manufactured by Beckman Coulter, Inc.).

More specifically, 0.02 g of toner base particles were added to and blended with 20 mL of surfactant solution (surfactant solution obtained by diluting, for example, neutral detergent including a surfactant component 10 times with pure water in order to disperse toner base particles), and then, ultrasonic dispersing treatment is applied for one minute to prepare dispersant of toner base particles, and this dispersant of the toner base particles was injected with a pipette into a beaker containing "ISOTON II" (manufactured by Beckman Coulter, Inc.) located inside a sample stand until concentration indication of the measuring device became 5 to 10 mass %. In the measuring device, measurement particle count number was set to 25000 pieces, an aperture diameter was set to 50 μm, a frequency value was calculated by dividing a measurement value range 1 to 30 μm into 256 sections, and a particle size corresponding to 50% of a largest volume-based cumulative fraction was determined as a volume average particle size.

Additionally, in the present Example, the average circularity of toner base particles (and toner particles) was measured as follows.

First, 10 mL of deionized water from which impurity solids and the like had been removed in advance was prepared in a container. The surfactant (alkylbenzene sulfonate) was added thereto as dispersant, and then 0.02 g of a measurement sample was further added and dispersed uniformly.

As a dispersing means, dispersing treatment was performed for two minutes by using the ultrasonic dispersing machine "TETORA150" (manufactured by Nikkaki Bios Co., Ltd.) to obtain dispersant for measurement. At this point, the dispersant was suitably cooled such that the temperature did not become 40° C. or more.

Additionally, in order to suppress variation in circularity, a device installation environment was controlled to be 23° C.±0.5° C. such that an inner temperature of a flow particle image analyzer "FPIA-2100" (manufactured by Sysmex Corporation) was kept within a range of 26 to 27° C., and automatic focus adjustment was performed by using 2 μm latex particles every two hours.

The above-described flow particle image analyzer was used to measure circularity of a toner base particle, and a concentration of the dispersant was readjusted such that a concentration of the toner base particles at the time of measurement becomes 3000 to 10,000 pieces/μL, and measurement was performed for 1000 or more toner base particles. After measurement, the average circularity of the toner base particles was acquired by using the above measurement data while cutting data of a circle equivalent diameter less than 2 μm.

(2) Manufacture of Toner Particles TW1

The white toner TW1 having an average circularity 0.877 was manufactured by adding, to 100 parts by weight of dried toner base particles TW1, 0.75 parts by weight of small diameter silica particles ("RX-200" fumed silica, applied with HMDS treatment, and having a number average particle diameter 12 nm: manufactured by Nippon Aerosil Co., Ltd.), 1.50 parts by weight of spherical silica fine particles ("X-249600" by a sol-gel manufacturing method, applied with the HMDS treatment, and having a number average particle size 80 nm: manufactured by Shin-Etsu Chemical Co., Ltd), 0.30 parts by weight of fatty acid metal salt S1, and 0.5 parts by weight of particles of calcium titanate as metal oxide microparticles having a high polishing effect ("TC-110" applied with silicone oil treatment and having a number average particle size 300 nm: manufactured by Titan Kogyo, Ltd.), and then mixing the same for 12 minutes at a treatment temperature 30° C. by using HENSCHEL MIXER "FM10B" (manufactured by Mitsui Miike Machinery Co., Ltd.) at a stirring blade rotational speed of 40 m/sec.

<Manufacture of Toners TW2 to TW5>

The white toners TW2 to TW5 were manufactured in a manner similar to the manufacture of the toner TW1 except that a pulverizing method and a cooling water temperature in manufacturing toner base particles were changed as illustrated in Table I.

TABLE I

| TONER BASE PARTICLE | | | | | | |
|---|---|---|---|---|---|---|
| | | MANUFACTURING METHOD | | VOLUME | | |
| Toner No. | COLORANT | PULVERIZING METHOD | COOLING WATER TEMPERATURE [° C.] | AVERAGE PARTICLE SIZE [μm] | AVERAGE CIRCULARITY | REMARKS |
| TW1 | ET-500W | TURBO MILL | 5 | 7.1 | 0.878 | PRESENT INVENTION |
| TW2 | ET-500W | TURBO MILL | 10 | 7.1 | 0.911 | PRESENT INVENTION |
| TW3 | ET-500W | TURBO MILL | 15 | 7.2 | 0.942 | PRESENT INVENTION |
| TW4 | ET-500W | I-TYPE MILL | — | 7.2 | 0.862 | COMPARATIVE EXAMPLE |
| TW5 | ET-500W | KRYPTRON | 10 | 7.2 | 0.975 | COMPARATIVE EXAMPLE |

<Manufacture of Toner T1>

(1) Preparation of Toner Base Particle T1

Binder resin: 100 parts by mass of styrene n-butyl acrylate copolymer (Mw: 111000, Mn: 4000, Mw/Mn: 26)

Colorant: 10 parts by mass of C.I. Pig. Yellow 74

Releasing agent: 5 parts by mass of polyolefin (VISCOL 660P, manufactured by Sanyo Chemical Industries, Ltd.)

Releasing agent: 5 parts by mass of alkylenebis fatty acid amide (HOECHST WAX C1, manufactured by Hoechst AG)

The above materials were mixed, melted, kneaded, and cooled, and then coarsely pulverized and then finely pulverized by using a turbo mill (cooling water temperature: 10° C.), and subsequently classified to prepare colored toner base particles T1 having a volume average particle size of 7.1 μm and an average circularity of 0.891.

(2) Manufacture of Toner T1

External addition treatment was performed by adding, to 100 parts by mass of dried toner base particles T1, 2.0 parts by mass of silica applied with n-butyltrimethoxysilane treatment (number average primary particle size of 30 nm) while setting a stirring blade rotational speed to 60 m/sec, a treatment temperature to 30° C., and a treatment time to twenty minutes in the HENSCHEL MIXER "FM10B" (manufactured by Nippon Coke & Engineering Co., Ltd.). After the external addition treatment, a colored toner T1 was manufactured by removing coarse particles by using a sieve having a mesh opening of 90 μm.

<Manufacture of Toners T2 to T4>

Colored toners T2 to T4 were manufactured in a manner similar to manufacture of the toner T1 except that the colorant thereof were changed to C.I. Pig. Red 57:1, C.I. Pig. Blue 15:3, and carbon black (BPL, manufactured by Cabot Corporation) respectively.

<Manufacture of Toner T5>

(1) Preparation of Resin Fine Particle (Preparing Step for Dispersant of Core Resin Particles [1])

A core resin fine particle [1] having a multilayer structure was prepared through first stage polymerization, second stage polymerization, and third stage polymerization described below.

(a) First Stage Polymerization (Preparation of Dispersant of Resin Fine Particles [A1])

Surfactant solution obtained by dissolving 4 parts by weight of polyoxyethylene-2-sodium dodecyl ether sulfate in 3,040 parts by weight of deionized water was set in a reaction vessel equipped with a stirrer, a temperature sensor, a condenser tube, and a nitrogen introduction device, and an internal temperature was increased to 80° C. while stirring the surfactant solution at a stirring speed of 230 rpm under a nitrogen stream. Polymerization (first stage polymerization) was performed to prepare dispersant of resin fine particles [A1] by: adding, to this surfactant solution, polymerization initiator solution obtained by dissolving 10 parts by mass of a polymerization initiator (potassium persulfate: KPS) in 400 parts by mass of deionized water; and then setting the temperature to 75° C.; charging droplets of monomer mixture solution including 532 parts by mass of styrene, 200 parts by mass of n-butyl acrylate, 68 parts by mass of methacrylic acid, and 16.4 parts by mass of n-octyl mercaptan for one hour; and heating and stirring this system at 75° C. for two hours.

Meanwhile, a weight average molecular weight (Mw) of the resin fine particles [A1] prepared by the first stage polymerization was 16,500.

Note that, in the present Example, the weight average molecular weight (Mw) was measured by using "HLC-8220" (manufactured by Tosoh Corporation) and a column "TSK GUARD COLUMN+TSK GEL SUPER HZM-M3 SERIES" (manufactured by Tosoh Corporation), tetrahydrofuran (THF) is made to flow as carrier solvent at a flow rate of 0.2 ml/min while keeping a column temperature at 40° C., a measurement sample is dissolved in the tetrahydrofuran so as to have a concentration of 1 mg/mL under dissolving conditions in which 5-minute treatment was performed using an ultrasonic dispersing machine at a room temperature, then the measurement sample was treated with a membrane filter having a pore size of 0.2 μm to obtain sample solution. Then, 10 μL of this sample solution was injected into the device together with the above-mentioned carrier solvent, and detection is performed by using a refractive index detector (RI detector) to calculate molecular weight distribution of the measurement sample by using a calibration curve measured by using monodispersed standard polystyrene particles. As a standard polystyrene sample for measurement of the calibration curve, those having molecular weights of $6\times10^2$, $2.1\times10^3$, $4\times10^3$, $1.75\times10^4$, $5.1\times10^4$, $1.1\times10^5$, $3.9\times10^6$, $8.6\times10^5$, $2\times10^6$, $4.48\times10^6$ manufactured by Pressure Chemical Company were used, and at least approximately ten standard polystyrene samples were measured to create the calibration curve. Additionally, a refractive index detector was used as the detector.

(b) Second Stage Polymerization (Preparation of Dispersant of Resin Particles [A2]: Formation of Intermediate Layer)

In a flask equipped with a stirrer, 93.8 parts by weight of paraffin wax "HNP-57" (manufactured by Nippon Seiro Co., Ltd.) was added as a releasing agent to monomer mixture liquid including 101.1 parts by mass of styrene, 62.2 parts by mass of n-butyl acrylate, 12.3 parts by mass of methacrylic acid, and 1.75 parts by mass of n-octylmercaptan, and then heated and dissolved at 90° C.

On the other hand, dispersant including an emulsified particle having a dispersed particle size of 340 nm was prepared by: heating, to 98° C., surfactant solution obtained by dissolving 3 parts by mass of sodium polyoxyethylene-2-dodecyl ether sulfate in 1560 parts by mass of deionized water; adding 32.8 parts by mass of the above-described dispersant of the resin fine particles [A1] (in terms of solid content); and mixing and dispersing monomer solution containing paraffin wax for eight hours by using a mechanical dispersing machine "CLEAR MIX" (manufactured by M Technique Co., Ltd.) having a circulation path. Subsequently, polymerization (second stage polymerization) was performed to prepare dispersant of resin fine particles [A2] by adding, to this emulsified particle dispersant, polymerization initiator solution obtained by dissolving 6 parts by mass of potassium persulfate is dissolved in 200 parts by mass of deionized water, and heating and stirring this system at 98° C. for twelve hours.

Meanwhile, a weight average molecular weight (Mw) of the resin fine particles [A2] prepared by the second stage polymerization was 23,000.

(c) Third Stage Polymerization (Preparation of Dispersant of Core Resin Particles [1]: Formation of Outer Layer)

Polymerization initiator solution obtained by dissolving 5.45 parts by mass of potassium persulfate in 220 parts by mass of deionized water was added to the above-described resin particles [A2], and droplets of monomer mixture liquid including 293.8 parts by mass of styrene, 154.1 parts by mass of n-butyl acrylate, and 7.08 parts by mass of n-octylmercaptan were charged for one hour under a temperature condition of 80° C. After charging the droplets, polymerization (third stage polymerization) was performed to obtain dispersant of core resin particles [1] by performing heating and stirring for two hours and then performing cooling down to 28° C.

Meanwhile, a weight average molecular weight (Mw) of the core resin fine particles [1] was 26,800.

Furthermore, a volume average particle size of the core resin fine particles [1] was 125 nm. As for this volume average particle size, a value measured by using a particle size distribution measuring device "COULTER MULTISIZER 3" (manufactured by Beckman Coulter, Inc.) was adopted.

Additionally, a glass transition temperature (Tg) of the core resin fine particles [1] was 30.5° C.

Meanwhile, in the present Wok Example, the glass transition temperature (Tg) was measured by using a differential scanning calorimeter "DIAMOND DSC" (manufactured by PerkinElmer, Inc.).

First, 3.0 mg of a sample was sealed inside an aluminum pan and set in a holder. As a reference, an empty aluminum pan was set. A DSC curve was obtained for the resin (core resin fine particle) under measurement conditions (temperature increase and cooling conditions) in which following processes were sequentially performed: a first temperature increasing process to increase a temperature from 0° C. to 200° C. at an increasing rate of 10° C./min; a cooling process to cool the temperature from 200° C. to 0° C. at a cooling rate of 10° C./min; and a second temperature increasing process to increase the temperature from 0° C. to 200° C. at an increasing rate of 10° C./min. The glass transition temperature (Tg) was determined at an intersection of two lines by drawing, on the basis of the DSC curve, an extension line of a base line before a rising point of a first endothermic peak in the second temperature increasing process and a tangent line representing a maximum inclination from the rising point of the first endothermic peak to a peak apex.

(Preparing Step for Dispersant of Shell-Layer Resin Particles [1])

Dispersant of shell-layer resin particles [1] was prepared by performing polymerization reaction and treatment after the reaction in a manner similar to the first stage polymerization of the core resin particle [1] except for using monomer mixture liquid in which contents were changed to 548 parts by mass of styrene, 156 parts by mass of 2-ethylhexyl acrylate, 96 parts by mass of methacrylic acid, and 16.5 parts by mass of n-octylmercaptan.

Meanwhile, a weight average molecular weight (Mw) of the shell-layer resin particles [1] was 26,800.

Additionally, a glass transition temperature (Tg) of the shell layer resin particle [1] was 49.8° C.

(2) Preparation of Dispersion of Colorant Fine Particle [1]

Dispersant of a colorant fine particles [1] obtained by dispersing colorant fine particles was prepared by: adding 90 parts by mass of sodium dodecylsulfate to 1,600 parts by mass of deionized water; gradually adding 420 parts by mass of C.I. Pig. Yellow 74 while stirring this solution; and subsequently performing dispersing treatment with a stirrer "CLEAR MIX" (manufactured by M Technique Co., Ltd.).

A particle size of the colorant fine particle in this dispersant of colorant fine particles [1] was measured by using electrophoretic light scattering spectrophotometer (ELS-800, Otsuka Electronics, Osaka, Japan), and found to be 110 nm in a volume average particle size.

(3) Preparation of Toner Base Particle T5

(a) Formation of Core Portion (Core Particle)

420 parts by mass (in terms of solid content) of the dispersant of the core resin fine particles [1], 900 parts by mass of deionized water, and 100 parts by mass of the dispersant of colorant fine particles [1] were set and stirred in a reaction vessel equipped with a temperature sensor, a condenser tube, an internal temperature, and a stirrer. After adjusting a temperature inside the reaction vessel to 30° C., a pH was adjusted to 8 to 11 by adding 5 mol/L of sodium hydroxide aqueous solution to this solution.

Then, aqueous solution obtained by dissolving 60 parts by mass of magnesium chloride hexahydrate as flocculant containing a Mg element in 60 parts by mass of deionized water was added and stirred at 30° C. for ten minutes. A temperature is increased after leaving the aqueous solution for three minutes, and 80 minutes was taken to increase the temperature of this system up to 80° C. (core formation temperature). In this state, a core portion (core particle) [1] was formed by: measuring a particle size of the particle with a flow particle image analyzer "FPIA-2100" (manufactured by Sysmex Corporation); adding aqueous solution obtained by dissolving 40.2 parts by mass of sodium chloride in 1000 parts by mass of deionized water to stop growth of the particle size when a volume-based average particle size of the particle (also referred to as "target particle size of a core particle") reached 5.8 μm; and further continuously performing fusion by performing heating and stirring for one hour at a liquid temperature of 80° C. (core maturity temperature) as a maturity treatment.

Meanwhile, circularity of a core portion (core particle) [1] was measured with the flow particle image analyzer "FPIA-2100" (manufactured by Sysmex Corporation), and the average circularity was 0.930.

(b) Formation of Shell Layer

Subsequently, a shell layer was formed by: adding 46.8 parts by mass (in terms of solid content) of the dispersant of the shell layer resin fine particles [1] at 65° C.; adding aqueous solution obtained by dissolving 2 parts by mass of magnesium chloride hexahydrate as flocculant containing a Mg element in 60 parts by mass of deionized water for ten minutes; then increasing a temperature up to 80° C. (shelling temperature); continuously stirring the same for one hour to fuse fine particles of the shell-layer resin particles [1] on a surface of a core portion (core particle) [1]; and then performing maturity treatment at 80° C. (shell maturity temperature) until predetermined circularity was achieved. Here, a colored toner base particle T5 having a core layer on the surface of the core portion (core particle), having a volume average particle size of 7.1 μm, and an average circularity of 0.951 was prepared by: adding aqueous solution obtained by dissolving 40.2 parts by mass of sodium chloride in 1000 parts by mass of deionized water; performing cooling down to 30° C. at a condition of 8° C./min; filtering obtained fused particles; repeatedly washing the same with deionized water at 45° C.; and then drying the same with warm air at 40° C.

(4) Manufacture of Toner T5

External addition treatment was performed by adding, to 100 parts by mass of dried toner base particles T5, 2.0 parts by mass of silica (number average primary particle size of 30 nm) applied with n-butyltrimethoxysilane treatment while setting a stirring blade rotational speed to 60 m/sec, a treatment temperature to 30° C., and a treatment time to twenty minutes in the HENSCHEL MIXER "FM10B" (manufactured by Nippon Coke & Engineering Co., Ltd.). After the external addition treatment, a colored toner T5 was manufactured by removing coarse particles by using a sieve having a mesh opening of 90 μm.

<Manufacture of Toners T6 to T8>

Colored toners T6 to T8 were manufactured in a manner similar to manufacture of toner T5 except that kinds of the colored colorant were changed to C.I. Pig. Red 57:1, C.I. Pig. Blue 15:3, carbon black (BPL, manufactured by Cabot Corporation).

TABLE II

| TONER NO. | COLORANT | MANUFACTURING METHOD | VOLUME AVERAGE PARTICLE SIZE [μm] | AVERAGE CIRCULARITY |
|---|---|---|---|---|
| | TONER BASE PARTICLE | | | |
| T1 | C.I.Pig. Yellow 74 | PULVERIZING METHOD (TURBO MILL) | 7.1 | 0.891 |
| T2 | C.I.Pig. Red 57:1 | PULVERIZING METHOD (TURBO MILL) | 7.2 | 0.917 |
| T3 | C.I.Pig. Blue 15:3 | PULVERIZING METHOD (TURBO MILL) | 7.1 | 0.884 |
| T4 | BPL | PULVERIZING METHOD (TURBO MILL) | 7.2 | 0.921 |
| T5 | C.I.Pig. Yellow 74 | EMULSION POLYMERIZATION METHOD | 7.1 | 0.951 |
| T6 | C.I.Pig. Red 57:1 | EMULSION POLYMERIZATION METHOD | 7.2 | 0.975 |
| T7 | C.I.Pig. Blue 15:3 | EMULSION POLYMERIZATION METHOD | 7.1 | 0.987 |
| T8 | BPL | EMULSION POLYMERIZATION METHOD | 7.2 | 0.962 |

«Evaluation»

As an evaluation machine, a commercially available digital printing system "BIZHUB PRESS C11005 developing machine, a remodeled machine (collective transfer+collective fixing by an intermediate transfer body, manufactured by Konica Minolta)" was used. In this evaluation machine, photographing was performed by charging 1000 g of developer despite a fact that a developer amount at the time of start was originally 1100 g.

The white toner and the colored toner obtained as described above were charged in an appropriate combination as specified in Table III (Experiment Nos. J1 to J16), and printing of 100,000 sheets was performed under an environment of 20° C. and 50% RH, and following evaluation was made in an initial state and in states after printing of 50,000 sheets and 100,000 sheets.

Evaluation results are provided in Table III.

<Image Density>

An image density of a solid image portion was measured by using a reflection density analyzer "RD-918" (manufactured by Macbeth Co., Ltd.) in the initial state and after printing 50,000 sheets and 100,000 sheets, and evaluation was made in accordance with the following evaluation criteria.

A white image density was measured by firstly preparing a high-quality black paper having an image density of about 1.35 (64 g/m$^2$), outputting a white solid image portion generated by the white toner to the high-quality black paper, measuring absolute image densities at 20 points using the reflection density analyzer "RD-918" manufactured by Macbeth, and calculating the white image density from the following equation.

white image density=density of high-quality black paper (average value of densities at 20 points of high-quality black paper having image density of about 1.35)−measured density of white solid portion (average value of densities at 20 points of white solid portion)

In a case where a white image density is 1.20 or more, there is no problem in practical use, but in a case of being less than 0.80, practical use is difficult.

A: 1.30 or more

B: 1.20 or more and less than 1.30

C: 0.80 or more and less than 1.20

D: Less than 0.80

<Fog Density>

A fog density was measured by using the reflection density analyzer "RD-918" (manufactured by Macbeth Co., Ltd.) in the initial state and after printing 50,000 sheets and 100,000 sheets, and evaluation was made in accordance with the following evaluation criteria. A fog density was measured by measuring a density of a non-image forming portion after printing. This measuring method is similar to the white image density measurement method described above.

fog density=density of high-quality black paper (average value of densities at 20 points of high-quality black paper having image density of about 1.35)−density of non-image forming portion (average value of densities at 20 points of non-image forming portion)

In a case where a fog density is less than 0.010, there is no problem in practical use, but in a case of being 0.015 or more, practical use is difficult.

A: Less than 0.005

B: 0.005 or more and less than 0.010

C: 0.010 or more and less than 0.015

D: 0.015 or more

<Cleaning Performance of Intermediate Transfer Body>

Cleaning performance of the intermediate transfer body was visually observed in the initial state and after printing 50,000 sheets and 100,000, and evaluation was made in accordance with the following evaluation criteria.

A: Good cleaning performance

B: Small spots and streaks of toner caused by passing-through of a toner are generated but do not appear on an image, and there is no problem in practical use C: Clear spots and streaks of toner caused by passing-through of a toner are generated and also appear on an image, and there is a problem in practical use <Separability in Fixing>

An image was formed by superimposing five solid images in the order of W, Y, M, C, Bk from a top of a paper in the initial state and after printing 50,000 sheets and 100,000 sheets, and then separability from a fixing machine was visually observed, and evaluation was made in accordance with the following evaluation criteria.

A: Fixing processing is good and fixing is uniformly performed in entire fixing area B: There is no problem in practical use although a small separation claw mark of the fixing machine remains in an entire solid image C: Separation claw cuts into an image while outputting an entire solid surface, and there is a problem in practical use

TABLE III

| | WHITE TONER | | | | | | | | | |
|---|---|---|---|---|---|---|---|---|---|---|
| | | | EXTERNAL ADDITIVE | | | | AVERAGE | | | |
| | | AVERAGE CIRCULARITY | | | VOLUME AVERAGE | | CIRCULARITY OF TONER | IMAGE DENSITY | | |
| EXPERIMENT NO. | NO. | OF TONER BASE PARTICLES | NO. | KINDS | PARTICLE SIZE [μm] | COLORED TONER | PARTICLES AFTER MANUFACTURING WHITE TONER | INITIAL STATE | AFTER 50000 SHEETS | AFTER 100000 SHEETS |
| J1 | TW1 | 0.878 | S1 | Zn-St | 0.72 | T1-T4 | 0.877 | A | A | A |
| J2 | TW2 | 0.911 | S1 | Zn-St | 0.72 | T1-T4 | 0.908 | A | A | A |
| J3 | TW3 | 0.942 | S2 | Zn-St | 0.51 | T1-T4 | 0.941 | A | A | A |
| J4 | TW1 | 0.878 | S3 | Zn-St | 1.48 | T5-T8 | 0.871 | A | A | A |
| J5 | TW2 | 0.911 | S1 | Zn-St | 0.72 | T5-T8 | 0.908 | A | A | A |
| J6 | TW3 | 0.942 | S2 | Zn-St | 0.51 | T5-T8 | 0.941 | A | A | B |
| J7 | TW1 | 0.878 | S4 | Ca-St | 0.78 | T1-T4 | 0.876 | A | A | A |
| J8 | TW2 | 0.911 | S4 | Ca-St | 0.78 | T1-T4 | 0.909 | A | A | A |
| J9 | TW3 | 0.942 | S5 | Ca-St | 0.52 | T1-T4 | 0.941 | A | A | A |
| J10 | TW1 | 0.878 | S6 | Ca-St | 1.49 | T5-T8 | 0.875 | A | A | A |
| J11 | TW2 | 0.911 | S4 | Ca-St | 0.78 | T5-T8 | 0.909 | A | A | A |
| J12 | TW3 | 0.942 | S5 | Ca-St | 0.52 | T5-T8 | 0.941 | A | A | A |
| J13 | TW1 | 0.878 | S7 | Zn-St | 0.42 | T1-T4 | 0.873 | A | B | C |
| J14 | TW1 | 0.878 | S8 | Zn-St | 1.67 | T1-T4 | 0.871 | A | B | C |
| J15 | TW4 | 0.862 | S1 | Zn-St | 0.72 | T1-T4 | 0.861 | A | B | C |
| J16 | TW5 | 0.975 | S1 | Zn-St | 0.72 | T1-T4 | 0.974 | A | B | C |

| | FOG DENSITY | | | CLEANING PERFORMANCE | | | SEPARABILITY IN FIXING | | | |
|---|---|---|---|---|---|---|---|---|---|---|
| EXPERIMENT NO. | INITIAL STATE | AFTER 50000 SHEETS | AFTER 100000 SHEETS | INITIAL STATE | AFTER 50000 SHEETS | AFTER 100000 SHEETS | INITIAL STATE | AFTER 50000 SHEETS | AFTER 100000 SHEETS | REMARKS |
| J1 | A | A | B | A | A | A | A | A | A | PRESENT INVENTION |
| J2 | A | A | A | A | A | A | A | A | A | PRESENT INVENTION |
| J3 | A | A | A | A | A | B | A | A | A | PRESENT INVENTION |
| J4 | A | A | A | A | A | B | A | A | A | PRESENT INVENTION |
| J5 | A | A | A | A | A | A | A | A | A | PRESENT INVENTION |
| J6 | A | A | A | A | A | A | A | A | A | PRESENT INVENTION |
| J7 | A | A | B | A | A | A | A | A | A | PRESENT INVENTION |
| J8 | A | A | A | A | A | A | A | A | A | PRESENT INVENTION |
| J9 | A | A | A | A | A | B | A | A | B | PRESENT INVENTION |
| J10 | A | A | A | A | A | A | A | A | B | PRESENT INVENTION |
| J11 | A | A | A | A | A | A | A | A | A | PRESENT INVENTION |
| J12 | A | A | A | A | A | A | A | A | B | PRESENT INVENTION |
| J13 | A | B | C | A | B | C | A | B | C | COMPARATIVE EXAMPLE |
| J14 | A | B | C | A | C | C | A | B | C | COMPARATIVE EXAMPLE |
| J15 | A | B | C | A | B | C | A | B | C | COMPARATIVE EXAMPLE |
| J16 | A | B | C | A | C | C | A | B | C | COMPARATIVE EXAMPLE |

CONCLUSION

As is clear from Table III, it was confirmed that image formation using a white toner for electrostatic image development of the present invention was superior to image formation using white toners for electrostatic charge image development in comparative examples in terms of image density, fog density, cleaning performance at the intermediate transfer body, and separability in fixing.

Judging from the above results, it was grasped that using a white toner for electrostatic charge image development containing a toner particle that includes a toner base particle including a binder resin, white colorant, and a releasing agent, and an external additive is effectively used in providing a highly stable high-quality full color image for a long period even under a high stress condition. The toner particle contains, as the external additive, a fatty acid metal salt particle having a volume-based median diameter in a range of 0.5 to 1.5 μm, and average circularity of toner particles is in a range of 0.870 to 0.950.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming method comprising at least charging, forming latent image, developing, transferring, fixing, and cleaning, wherein the transferring includes:

primarily transferring, to an intermediate transfer body, a white toner for electrostatic charge image development and a colored toner for electrostatic charge image development including colored colorant other than white; and secondarily transferring, onto a transfer material, a toner image formed on the intermediate transfer body, the white toner for electrostatic charge image development is transferred to the intermediate transfer body corresponding to a non-image forming region located between the transfer materials consecutively conveyed, the white toner on the intermediate transfer body corresponding to the non-image forming region is not transferred to the transfer material, in the cleaning, the white toner on the intermediate transfer body corresponding to the non-image forming region is recovered and also the intermediate transfer body is cleaned by using the white toner on the intermediate transfer body corresponding to the non-image forming region, the white toner for electrostatic charge image development contains a toner particle that includes a toner base particle containing a binder resin, a white colorant, and a releasing agent, and an external additive, the toner particle contains, as the external additive, a fatty acid metal salt particle having a volume-based median diameter in a range of 0.5 to 1.5 μm, an average circularity of the toner particles is in a range of 0.870 to 0.950, and the fatty acid metal salt particle consists of at least one of zinc stearate, aluminum stearate, copper stearate, magnesium stearate, calcium stearate, zinc oleate, manganese oleate, copper oleate, magnesium oleate, zinc palmitate, copper palmitate, magnesium palmitate, calcium palmitate, zinc linoleate, or calcium linoleate.

2. The image forming method according to claim 1, wherein the fatty acid metal salt is zinc stearate.

3. The image forming method according to claim 1, wherein an average circularity of toner base particles contained in the colored toner for electrostatic charge image development is in a range of 0.951 to 0.990.

* * * * *